US009933217B2

(12) United States Patent
Orban

(10) Patent No.: US 9,933,217 B2
(45) Date of Patent: Apr. 3, 2018

(54) GRIPPER DEVICE FOR HOLDING THE MUNITION WHEN LOADING A GUN

(71) Applicant: COCKERILL MAINTENANCE & INGENIERIE S.A., Seraing (BE)

(72) Inventor: Henri Orban, Eben-Emael (BE)

(73) Assignee: CMI DEFENCE S.A., Loncin (BE)

( * ) Notice: Subject to any disclaimer, the term of this patent is extended or adjusted under 35 U.S.C. 154(b) by 0 days.

(21) Appl. No.: 14/910,257

(22) PCT Filed: Aug. 6, 2014

(86) PCT No.: PCT/EP2014/066874
§ 371 (c)(1),
(2) Date: Feb. 5, 2016

(87) PCT Pub. No.: WO2015/022245
PCT Pub. Date: Feb. 19, 2015

(65) Prior Publication Data

US 2016/0178300 A1 Jun. 23, 2016

(30) Foreign Application Priority Data

Aug. 12, 2013 (BE) ..... 2013/0539

(51) Int. Cl.
*F41A 9/42* (2006.01)
*F41A 9/22* (2006.01)

(52) U.S. Cl.
CPC . *F41A 9/22* (2013.01); *F41A 9/42* (2013.01)

(58) Field of Classification Search
CPC ..... F41A 9/00; F41A 9/01; F41A 9/06; F41A 9/09; F41A 9/20; F41A 9/22; F41A 9/38; F41A 9/39; F41A 9/54; F41A 9/56; F41A 9/58; F41A 9/42
USPC ..... 89/45, 46, 47, 1.35, 1.801, 1.805
See application file for complete search history.

(56) References Cited

U.S. PATENT DOCUMENTS 1,304,583 A * 5/1919 McClain ..... F41A 9/16
89/46
2,972,934 A * 2/1961 Platt ..... F41A 9/05
198/680
2,987,963 A * 6/1961 Eaton ..... F41A 9/42
212/231
3,069,026 A * 12/1962 Aluise ..... F41A 9/20
414/142.6

(Continued)

FOREIGN PATENT DOCUMENTS

DE 2330889 A1 1/1975
WO WO 2006051425 A2 5/2006

*Primary Examiner* — Jonathan C Weber
(74) *Attorney, Agent, or Firm* — Leydig, Voit & Mayer, Ltd.

(57) ABSTRACT

A gripper device for transporting munitions, has a support movably mounted along the longitudinal direction of the munition. The support has feet delimiting a space intended to receive the munition, the feet being movably mounted in a plane perpendicular to the direction of forward travel of the support and configured so as to adopt, during use, a position referred to as a locking position. The feet are fixed and able to clasp the periphery of the munition, and a position referred to as unlocking position. The feet are free to move in the plane perpendicular to the direction of forward travel of the support so as to allow the passage of the whole of the munition in its longitudinal direction.

14 Claims, 3 Drawing Sheets

(56) References Cited

U.S. PATENT DOCUMENTS

| | | | | | |
|---|---|---|---|---|---|
| 3,141,375 | A * | 7/1964 | Randall | F41A 9/01 | 29/824 |
| 3,598,016 | A | 8/1971 | Chiabrandy et al. | | |
| 3,893,366 | A * | 7/1975 | Murray | F41F 3/0406 | 89/1.801 |
| 4,700,609 | A * | 10/1987 | Wiethoff | F41A 9/16 | 89/46 |
| 4,898,071 | A | 2/1990 | Borgwarth | | |
| 6,457,397 | B1 * | 10/2002 | Guesnet | F41A 9/42 | 89/46 |
| 6,460,448 | B1 | 10/2002 | Zangrando | | |
| 6,591,733 | B1 * | 7/2003 | Engstrom | F41A 9/16 | 89/33.05 |
| 7,207,257 | B2 * | 4/2007 | Yu | F41A 9/56 | 89/45 |

* cited by examiner

GRIPPER DEVICE FOR HOLDING THE MUNITION WHEN LOADING A GUN

CROSS-REFERENCE TO RELATED APPLICATIONS

This application is a U.S. national stage application under 35 U.S.C. § 371 of International Application No. PCT/EP2014/066874 filed on Aug. 6, 2014, and claims benefit to Belgian Patent Application No. 2013/0539, filed on Aug. 12, 2013. The International Application was published in French on Feb. 19, 2015, as 2015/022245 A1 under PCT Article 21(2).

FIELD

The technical field of the invention is that of systems for automatically loading large caliber guns (75 mm to 140 mm) with munitions, equipping armored vehicles and tanks, and more particularly, to a device for bringing the munition from the storage area to the chamber of the gun.

BACKGROUND

On armored vehicles and tanks, the phase for transporting the munition from the storage area to the gun is carried out while the vehicle is moving, possibly on a rugged terrain, which generates vibrations and shocks. Consequently, a significant difficulty encountered in this phase is correctly holding the munition while it is brought to the gun. This hold should be sufficiently rigid in order to ensure:

- safety of the members of the crew who are potentially in close proximity to the loading area;
- observance of the integrity and the preservation of the physical properties and the performances of the munition;
- easy, secure and smooth insertion of the munition into the chamber of the gun.

Properly holding the munition while it is brought towards the gun most often leads to the design of devices for transporting the munition consisting of the sheath on which the munition is laid, the sheath being provided with a telescopic mechanism. This solution includes several drawbacks:

- as the munition lies in a natural position in the sheath, its longitudinal axis is not aligned on the axis of the gun, which proves to be a problem for inserting it into the chamber of the gun, in particular with munitions for which the shape of the projectile comprises a sharp edge that forms an obstacle at the inlet of the chamber;
- the sheath having an inevitable bulk in height over the whole length of the munition, it potentially interferes with the mechanism of the storage magazine, which generates additional technical constraints. These constraints are typically solved either by equipping each munition housing with an individual tube, which increases the mass of the equipment, or by making the sheath in the form of a more complex retractable mechanism;
- upon loading under severe driving conditions, the munition, as it is not firmly maintained during the transport phase, moves in the vertical plane.

Other devices for gripping the munition exist.

Document DE2330889 A1 discloses a system for loading munitions with a gripper device provided with pivotally mounted jaws. The munition is borne at two locations with rollers and taken by the gripper device at the base of the case. The drawback of this system is that the munition simply rests on the rollers and is taken in a location outside the center of gravity. During the loading under severe driving conditions, as the munition is not firmly held during the transport phase, it may move in the vertical plane.

Document WO 2006/051425 A2 discloses a device for handling weapons aiming at transporting and loading weapons on an airplane or other vehicles. The device is provided with a clamp that comprises rollers intended to be positioned on the periphery of the weapon to be held. The weapon clamp further comprises a removable link adapted for moving at least one of the rollers from a first position wherein the weapon is held in position by contact with the rollers towards a second position wherein the roller releases the weapon, allowing it to move in a transverse direction. This system has the drawback that the gripping operation is carried out in the magazine of munitions and requires one clamp for each stored munition. Further, the clamp system has the disadvantage that it does not allow sliding of the munition along a longitudinal movement required for transporting a munition from the magazine to the chamber of the gun.

Document U.S. Pat. No. 6,460,448 B1 discloses a device for loading shells in a mortar through the muzzle. This device comprises means for raising the shell moving linearly by means of guides and jaws gripping its periphery. Upon arriving at the muzzle, the shell is translated by means of a transfer device so as to be positioned in the axis of the mortar and inserted into the muzzle of the latter.

SUMMARY

An aspect of the invention provides a gripper device for transporting a munition, the device comprising: a support, movably mounted along a longitudinal direction of the munition, wherein the support includes feet delimiting a space configured to receive the munition. The feet are movably mounted in a plane perpendicular to a forward travel direction of the support. The feet are configured so as to adopt, during use, a locking position in which the feet are fixed and able to clasp a periphery of the munition. The feet are configured so as to adopt an unlocking position in which the feet are free to move in the plane perpendicular to the forward travel direction of the support, so as to allow passage of a whole munition in its longitudinal direction. The space delimited by the feet includes a circular section with a diameter increasing in a direction from a head to a base of the munition intended to be received in the feet.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
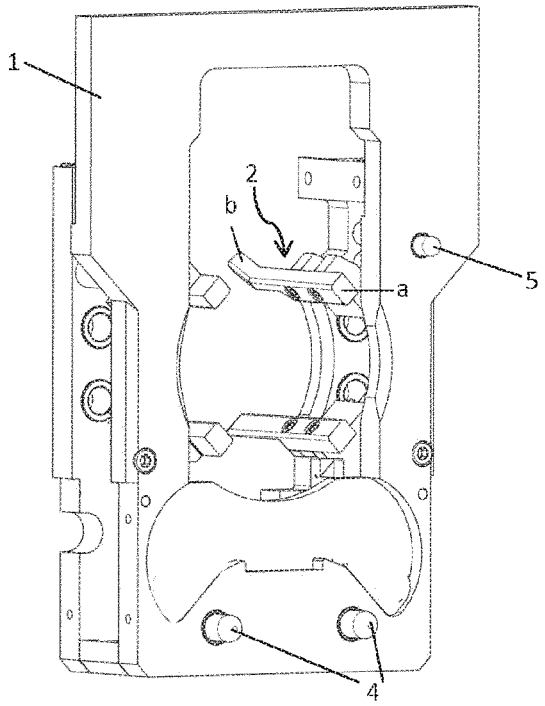
FIG. 1 illustrates a partial view of the gripper device for the munition according to the invention, which involves a view of the front face of the support, i.e., the face intended to abut against the breech of the gun.

An aspect of the invention overcomes the above-mentioned drawbacks by proposing a new technical solution allowing the munition to be firmly held during the whole of its path until the projectile is being inserted into the chamber of the gun, and leaving free the running area of the munitions in the storage magazine, while observing the gripping areas recommended by the STANAG standards.

An aspect of the present invention relates to a gripper device for transporting munitions comprising a support movably mounted along the longitudinal direction of the munition, said support comprising feet delimiting a space intended to receive the munition, said feet being movably mounted in a plane perpendicular to the direction of forward travel of the support and configured so as to adopt, during use, a position referred to as locking position, wherein the feet are fixed and are able to clasp the periphery of the munition, and a position referred to as unlocking position, wherein the feet are free to move in the plane perpendicular to the direction of forward travel of the support so as to allow the passage of the whole of the munition in its longitudinal direction.

According to particular embodiments of the invention, the device comprises at least one or a suitable combination of the following features:

- the space delimited by the feet has a circular section with an increasing diameter, said diameter increasing in a direction from the head of the munition to the base of the munition which is intended to be received in the feet,
- the feet delimit a space at least partly of a conical shape,
- a first portion of the feet has an increasing diameter intended to fit the conical shape of the munition when the feet are in a locking position,
- a second portion of the feet has an increasing diameter greater in any point than that of the munition in order to facilitate its insertion when the feet are in the locking position,
- it comprises an unlocking mechanism ensuring the change in position of the feet from the locking position to the unlocking position, said mechanism comprising retractable fingers, referred to as unlocking fingers, positioned on the support, the retraction of the fingers inside the support triggering, during use, the unlocking mechanism,
- it comprises a mechanism for returning the support after the transport of the munition, said mechanism comprising a bolt movably mounted on the support, a return spring and a retractable finger, referred to as return finger, positioned on the support, the retraction of said return finger causing retraction of the bolt and the return of the support by means of the return spring,
- the length of the return finger is less than that of the unlocking fingers,
- the support has a shape close to a laid L, the vertical portion of the L comprising the feet and the horizontal portion of the L being intended to be positioned along a sheath comprising the munition,
- the feet are intended to come exclusively into contact with the case of the munition and to clasp an area located between one third and two thirds of the height of the munition,
- it comprises a mechanism for driving the munition and the support, said mechanism comprising a carriage provided with a pusher finger, said pusher finger being intended to cooperate with the base of the munition and the carriage being intended to cooperate with the support,
- the pusher finger is, during use, intended to push the munition into the space delimited by the feet until it is clasped and the carriage is, during use, intended to exert pressure on the support as soon as the munition is clasped in the feet, the support consequently moving along the longitudinal direction of the munition by the joint action of the pusher finger on the munition and the carriage on the support,
- the carriage cooperates with the bolt mounted on the support,
- the feet are four in number and regularly spaced out along the perimeter of the circular section space.

An aspect of the present invention further relates to a method for transporting and loading a munition from a magazine to a gun chamber by means of the device as described above, said method comprising the steps of:

- Placing a sheath of the magazine comprising the munition in front of the feet of the support, said support being in a position referred to as loading position,
- Actuating the pusher finger in order to insert the munition in the space delimited by the feet,
- Clasping the munition in the feet when the latter cover an area comprising the center of gravity of the munition, and, abutment of the carriage on the bolt of the support, the action of the pusher finger on the munition and the abutment of the carriage on the bolt causing the support to move along the longitudinal direction of the munition,
- Abutment of the support against the breech of the gun triggering in a first phase the mechanism for unlocking the feet and allowing the loading of the munition into the chamber of the gun by means of the pusher finger.

According to a particular embodiment of the invention, the device also comprises the following features:

- the abutment of the support against the breech of the gun triggers in a second phase the mechanism for returning the support into the loading position.

An aspect of the present invention relates to a device for gripping the munition able to move longitudinally from the magazine where the munitions are stored to the chamber of the gun.

Figure 2:
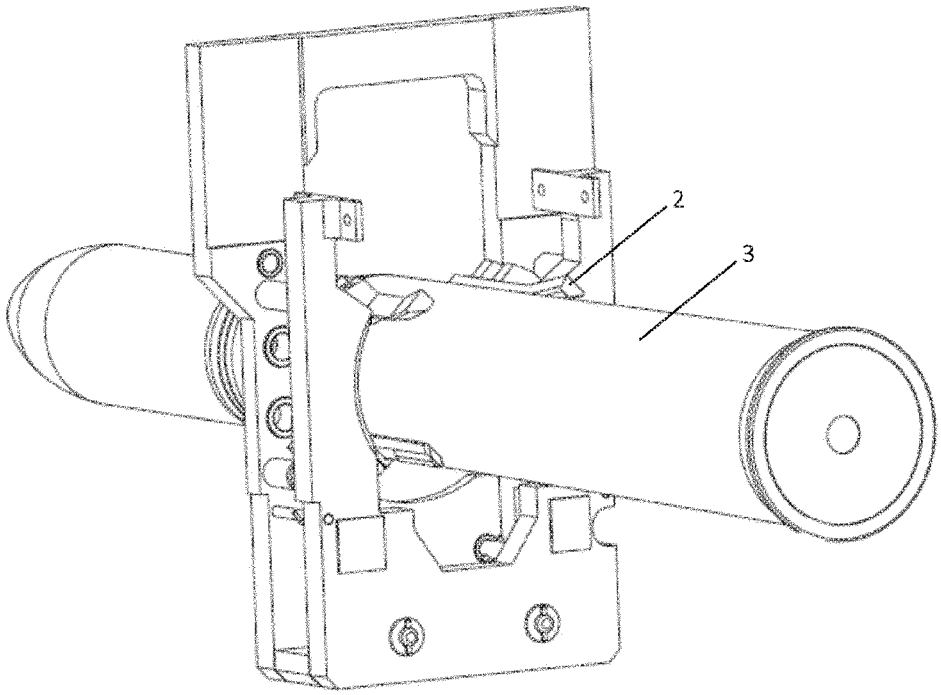
FIG. 2 illustrates a rear view of the device of FIG. 1 with one munition held between the feet of the gripper device.

The gripper device according to the invention and as partly shown in FIGS. 1 and 2 comprises several feet 2 intended to be positioned on the perimeter of the case of the munition 3 in proximity to its center of gravity and to clasp the case over a sufficient length to prevent any swinging of the munition. The positioning of the feet is determined depending on the mass, on the position of the center of gravity and on the moment of inertia of the munition. Practically, the feet cover an area located between ⅓ and ⅔ of the height of the munition, this area may be of a length of less than ⅓ of the height of the munition. The feet are spaced apart on the perimeter of the case of the munition and may for example be four in number, spaced along four generatrices of the case in an equidistant way.

According to the invention, the gripper device is equipped with a mechanism for locking/unlocking the feet. As indicated by its name, in the locked position, the feet are fixed, while in an unlocked position, they are free to move radially allowing the munition to totally pass along its longitudinal direction in both directions.

The gripper device according to the invention comprises a support 1 provided with an aperture to allow the munition to pass (FIGS. 1 and 2). The gripping feet 2 are mounted on the support within the aperture and are able to move radially between a closing position, referred to as locking position, and an opening position, referred to as unlocking position. During use, as explained below, the feet move together between the locking position and the unlocking position.

Figure 3:
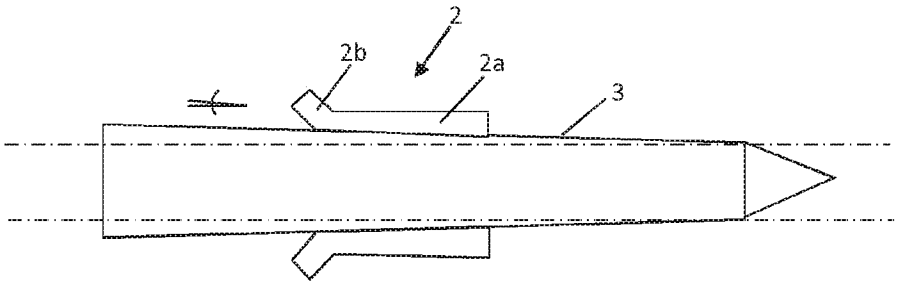
FIG. 3 illustrates a longitudinal sectional view of the feet of the gripper device according to the invention holding the munition.

The gripping feet delimit a circular section space with an increasing diameter visible in FIG. 3. Thus, each gripping foot has a first portion 2*a* flaring towards a second portion 2*b* in a direction extending from the front face of the support, i.e. the face intended to come into contact with the breech of the gun, towards the rear face of the support. This first portion 2*a* comprises a contact surface intended to fit the slightly conical shape of the case of the munition. The second portion 2*b* has a more flared shape facilitating the insertion of the munition into the feet.

The gripper device according to the invention comprises a mechanism for unlocking the feet actuated by contact of retractable fingers, referred to as unlocking fingers, with an outer element. According to the invention, the retractable fingers 4 are positioned on the front face of the support (FIG. 1). During use, this face abuts against the breech of the gun, which, via the retraction of the fingers inside the support, triggers the joint opening of the feet and allows the munition to enter the chamber of the gun. According to the embodiment of FIG. 1, the fingers 4 located on the left and on the right respectively and independently trigger the radial opening of the feet located on the left and on the right. Different systems may be contemplated for binding the retraction of the fingers 4 with the radial expansion of the feet. As an example, each lower foot may be secured with a part which will be housed in a notch of another part secured to the finger 4 when the feet are in a locked position. During use, the retraction of the finger 4 allows release of the part secured to the lower foot and consequently causes it to move outwards under the effect of the weight of the munition. The movement of the upper foot is, as for it, related to that of the lower foot, for example via a gear. In the unlocked position, the feet are thereby free to move radially, the amplitude of the spacing depending on the type of munition.

The gripper device further comprises a return mechanism allowing the return of the support in front of the position for loading the magazine after transport of the munition into the chamber of the gun. The mechanism comprises a bolt 12 shown in FIG. 4. The bolt 12 is pivotally mounted on the support 1 and provided with an abutment 13. The return mechanism further comprises a return finger 5, positioned on the front face of the support (FIG. 1) and a return spring. During use and as explained below, the retraction within the support of the return finger 5 triggers retraction of the bolt and consequently the return of the support under the effect of the return spring. As an example, the link between the return finger and the bolt may be ensured via a rod. In order to allow unlocking of the feet before the return of the support, the length of the return finger is less than that of the unlocking fingers.

Figure 4:
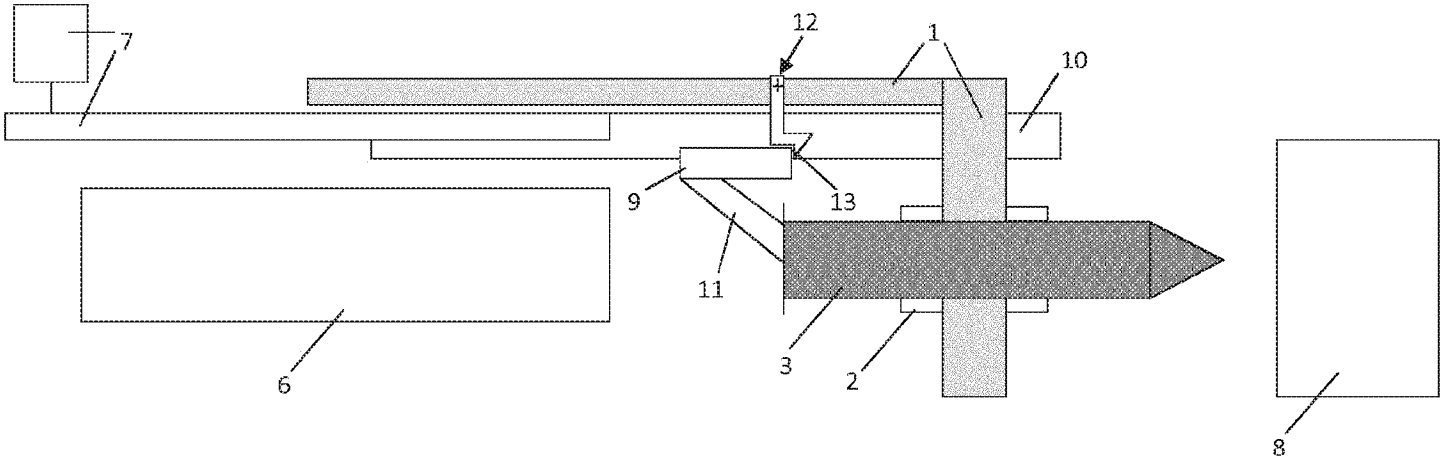
FIG. 4 illustrates a schematic view of the different elements intervening during the transport of the munition from the sheath of the magazine to the chamber of the gun.

The support 1 seen as a whole in FIG. 4 has a shape close to a laid L. The feet 2 are positioned on the vertical portion of the laid L, i.e., the small dimension portion of the L, while the horizontal portion of the L is intended to be positioned along the sheath 6 comprising the munition 3 in the magazine.

The mechanism for driving the support 1 comprises a fixed portion 7 provided with a motor, a pusher frame 10 slidably mounted on this fixed portion 7 and a carriage 9 itself slidably mounted on the pusher frame 10, for example by means of a chain system which connects the fixed portion 7 to the carriage 9. The carriage 9 comprises a pusher finger 11 intended to move the munition 3 from the magazine 6 to the chamber of the gun 8. The movement of the support 1 is on the one hand indirectly carried out via the movement of the munition 3 which is clasped in the feet 2 of the support and pushed at its base by the pusher finger 11, and, via the carriage 9 on the other hand which exerts pressure on the abutment 13 of the bolt 12 secured to the support 1.

Figure 5:
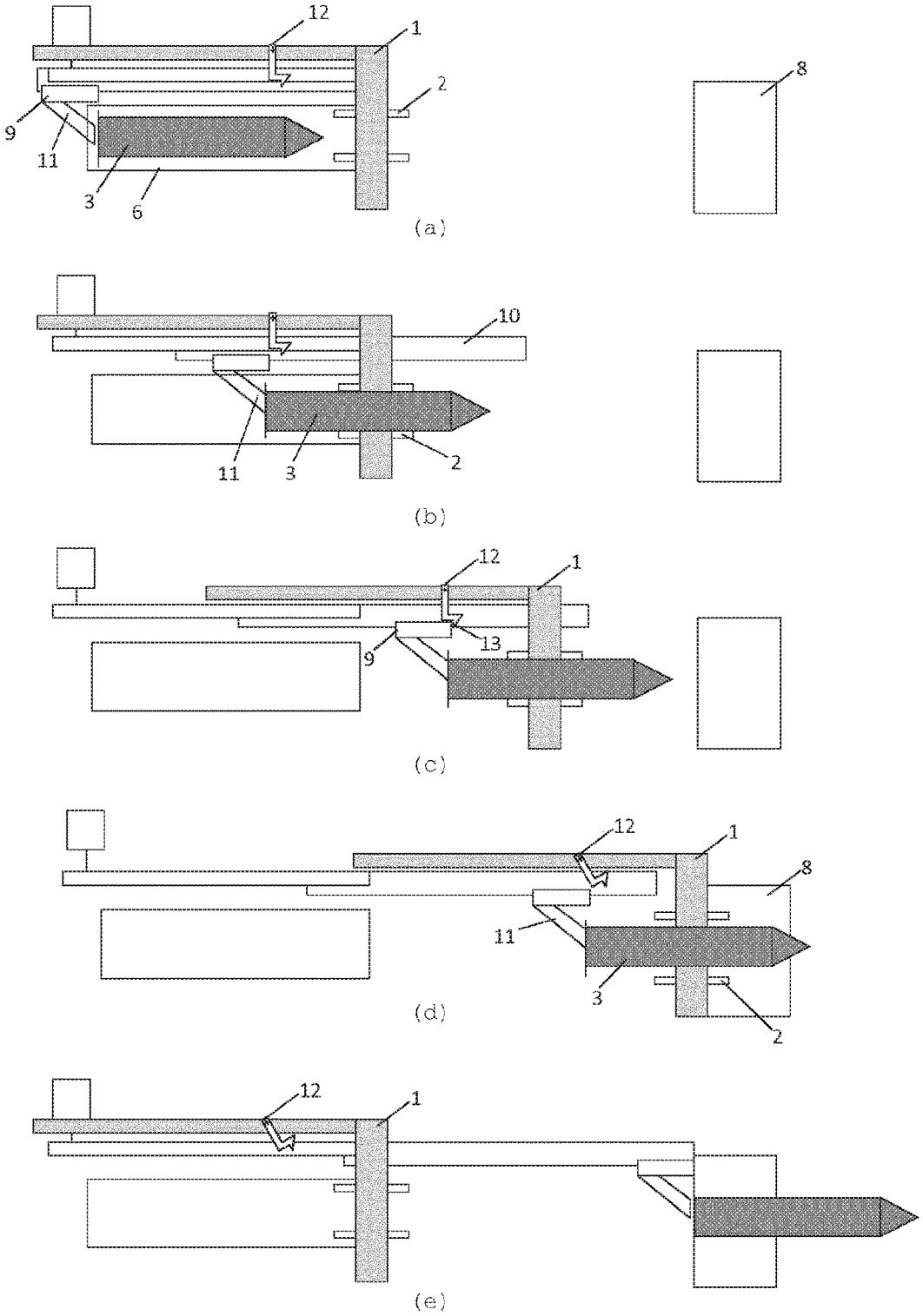
FIG. 5 schematically illustrates with sequential views (a)-(e) the movement of the munition from the magazine to the chamber of the gun.

The operation of the device according to the invention is schematically illustrated in FIG. 5. The support 1 is positioned in a given location in front of one of the sheaths 6 of the magazine, referred to as loading position. When a munition 3 has to be loaded, the sheath 6 comprising the munition 3 to be loaded is placed in the loading position (FIG. 5(*a*)) by means of a conveyer. Next, the pusher frame 10 on which the carriage 9 provided with the finger 11 is mounted, comes into action (FIG. 5(*b*)). The pusher finger 11 exerts pressure on the base of the munition 3 in order to insert it into the space delimited by the feet 2 which, by default, are in a locked position. Because of its slightly conical shape (not shown in the schematic FIG. 5) and the given spacing of the feet, the munition is blocked in the latter when the feet cover the portion of the case where the center of gravity of the munition is located. In parallel, the carriage 9 abuts against the bolt 12 and more specifically, its abutment 13 (FIG. 5(*c*)). The joint action of the pusher finger 11 on the munition 3 clasped in the gripping support 1 and of the carriage 9 on the bolt 12 consequently causes the support 1 to move. At the end of the travel, as shown in FIG. 5(*d*), the support 1 abuts against the breech of the gun 8, which triggers in a first phase the radial spacing of the feet via the retraction of the unlocking fingers as mentioned earlier and allows the munition 3 to be loaded into the chamber of the gun 8 by means of the pusher finger 11 still in motion (FIG. 5(*d*)). In a second phase, the contact of the return finger with the breech of the gun ensures the return of the support 1 into the loading position by means of retraction of the bolt 12 and of the return spring (FIGS. 5(*d*) and (*e*)). Next, the carriage 9 returns into its starting position of FIG. 5(*a*) under the action of the motor. It will be specified that if there is a defect of the spring that would prevent the return of the support into its loading position, the return of the support may be carried out via the carriage. The bolt is then retracted and the carriage takes position on the rear portion of the support in order to drive it into its motion.

By means of the gripper device according to the invention, the support therefore accompanies the munition from the magazine to the chamber of the gun according to a longitudinal movement, preventing any swing of the latter by means of the feet.

The gripper device according to the invention provides controlled and easily adjustable clasping guaranteeing the obtainment of an optimum which both gives the possibility:

- of not damaging the case,
- of having sufficient clasping so as to avoid any vibration or instability of the munition under strongly stressed driving conditions,
- of having an un-excessive clasping which allows easy unlocking at the end of the cycle.

The device is naturally positioned in an unlocked position and is automatically unlocked upon contact with the breech of the gun, when the munition enters into the chamber.

The device provides the possibility of being blocked permanently in an unlocked position, allowing insertion of munitions into the magazine through the device via the inside of the vehicle rather than through the rear door of the magazine.

The device is not affected by the type of munition and the shape of the projectile, due to the fact that the hold is exclusively done on the case of the munition, and, as regard to the NATO calibers, is done in a location compliant with the "grip area" recommended by the applicable STANAGS standards.

The device lets the running area of the munitions totally free within the conveyor of the magazine.

The device holds the longitudinal axis of the munition strictly parallel to the movement direction of the latter upon its movement towards the gun, and fixed with respect to the munition magazine.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

KEY TO THE FIGURES (1) Support
(2) foot also referred to as jaw
(a) first portion
(b) second portion
(3) Munition with its case
(4) Unlocking finger
(5) Return finger
(6) Sheath
(7) Fixed portion with the motor
(8) Gun
(9) Carriage
(10) Pusher frame
(11) Pusher finger
(12) Bolt
(13) Abutment

The invention claimed is:

1. A gripper device for transporting a munition, the device comprising:

a support, movably mounted along a longitudinal direction of the munition, the support including feet delimiting a space configured to receive the munition, wherein the feet are configured so as to adopt, during use, a locking position in which the feet are fixed and able to clasp a periphery of the munition, wherein the feet are configured so as to adopt an unlocking position in which the feet are free to move in a plane perpendicular to a forward travel direction of the support so as to allow passage of a whole munition in its longitudinal direction, wherein the space delimited by the feet includes a circular section with a diameter increasing in a direction from a head to a base of the munition intended to be received in the feet, and wherein the feet are slidably mounted in the plane perpendicular to the forward travel direction of the support so as to slide between the locking position and the unlocking position, and each foot comprises a first portion that extends along the longitudinal direction of the munition so as to make contact with the munition along an entire length of the first portion when the munition is received in the feet when the feet are in the locking position.

2. The device of claim 1, wherein a first portion of the feet has an increasing diameter intended to fit a conical shape of the munition when the feet are in the locking position, and wherein a second portion of the feet has an increasing diameter greater in any point than that of the munition in order to facilitate its insertion when the feet are in a locking position.

3. The device of claim 1, wherein the support has a shape close to that of L, wherein a vertical portion of the L includes the feet and a horizontal portion of the L being configured to be positioned along a sheath including the munition.

4. The device of claim 1, wherein the feet are configured to come exclusively into contact with the case of the munition and to clasp an area located between one third and two thirds of a height of the munition.

5. The device of claim 1, further comprising:

a driving mechanism, configured to drive the munition and the support, wherein the driving mechanism includes a carriage including a pusher finger, wherein the pusher finger is configured to cooperate with the base of the munition, and wherein the carriage is configured to cooperate with the support.

6. The device of claim 5, wherein the pusher finger is, during use, configured to push the munition into the space delimited by the feet until the munition is clasped, wherein the carriage is, during use, configured to exert pressure on the support as soon as the munition is clasped in the feet, and wherein the support consequently moves along the longitudinal direction of the munition by joint action of the pusher finger on the munition and of the carriage on the support.

7. The device of claim 5, wherein the carriage cooperates with a bolt mounted on the support.

8. The device of claim 1, wherein the feet are four in number and regularly spaced out along the perimeter of the space with a circular section.

9. The device of claim 1, wherein the feet are regularly spaced out along a perimeter of the space with the circular section.

10. A gripper device for transporting a munition, the device comprising:

a support, movably mounted along a longitudinal direction of the munition, wherein the support includes feet delimiting a space configured to receive the munition, wherein the feet are movably mounted in a plane perpendicular to a forward travel direction of the support, wherein the feet are configured so as to adopt, during use, a locking position in which the feet are fixed and able to clasp a periphery of the munition, wherein the feet are configured so as to adopt an unlocking position in which the feet are free to move in the plane perpendicular to the forward travel direction of the support, so as to allow passage of a whole munition in its longitudinal direction, wherein the space delimited by the feet includes a circular section with a diameter increasing in a direction from a head to a base of the munition intended to be received in the feet, the device further comprising an unlocking mechanism configured to ensure a change in position of the feet from the locking position to the unlocking position, wherein the unlocking mechanism includes retractable fingers, referred to as unlocking fingers, positioned on the support, and wherein retraction of the fingers inside the support triggers, during use, the unlocking mechanism.

11. A gripper device for transporting a munition, the device comprising:

a support, movably mounted along a longitudinal direction of the munition, wherein the support includes feet delimiting a space configured to receive the munition, wherein the feet are movably mounted in a plane perpendicular to a forward travel direction of the support, wherein the feet are configured so as to adopt, during use, a locking position in which the feet are fixed and able to clasp a periphery of the munition, wherein the feet are configured so as to adopt an unlocking position in which the feet are free to move in the plane perpendicular to the forward travel direction of the support, so as to allow passage of a whole munition in its longitudinal direction, wherein the space delimited by the feet includes a circular section with a diameter increasing in a direction from a head to a base of the munition intended to be received in the feet, the device further comprising a return mechanism configured to return the support after transport of the munition, wherein the return mechanism includes a bolt, movably mounted on the support, a return spring, and a retractable return finger positioned on the support, and wherein retraction of the return finger causes retraction of the bolt and the return of the support using the return spring.

12. The device of claim 11, wherein a length of the return finger is less than that of the unlocking fingers.

13. A method for transporting and loading a munition from a magazine to a gun chamber using a gripper device, the gripper device comprising a support, movably mounted along a longitudinal direction of the munition, wherein the support includes feet delimiting a space configured to receive the munition, wherein the feet are movably mounted in a plane perpendicular to a forward travel direction of the support, wherein the feet are configured so as to adopt, during use, a locking position in which the feet are fixed and able to clasp a periphery of the munition, wherein the feet are configured so as to adopt an unlocking position in which the feet are free to move in the plane perpendicular to the forward travel direction of the support, so as to allow passage of a whole munition in its longitudinal direction, wherein the space delimited by the feet includes a circular section with a diameter increasing in a direction from a head to a base of the munition intended to be received in the feet, the method comprising:

placing a sheath of the magazine, including the munition, in front of the feet of the support, the support being in a loading position;

actuating a pusher finger in order to insert the munition into the space delimited by the feet;

clasping the munition in the feet when the feet cover an area including a center of gravity of the munition, and, an abutment of a carriage on the bolt of the support, the action of the pusher finger on the munition and the abutment of the carriage on the bolt causing the support to move along the longitudinal direction of the munition; and abutting the support against a breech of the gun chamber so as to trigger in a first phase an unlocking mechanism for the feet and allowing loading of the munition into the gun chamber using the pusher finger.

14. The method of claim 13, wherein the abutting triggers, in a second phase, a return mechanism of the support to the loading position.

* * * * *